US007076816B1

(12) United States Patent
Nielsen et al.

(10) Patent No.: US 7,076,816 B1
(45) Date of Patent: Jul. 18, 2006

(54) TOWEL OR BLANKET WITH INTEGRAL CARRYING CASE

(76) Inventors: Tina Marie Nielsen, P.O. Box 2634, La Pine, OR (US) 97739; Larry M. Nielsen, P.O. Box 2634, La Pine, OR (US) 97739

( * ) Notice: Subject to any disclaimer, the term of this patent is extended or adjusted under 35 U.S.C. 154(b) by 636 days.

(21) Appl. No.: 09/591,539

(22) Filed: Jun. 9, 2000

Related U.S. Application Data

(60) Provisional application No. 60/140,235, filed on Jun. 21, 1999.

(51) Int. Cl.
*A47G 9/06* (2006.01)

(52) U.S. Cl. ..... 5/417; 383/4; 297/188.06

(58) Field of Classification Search ..... 383/4; 5/417, 419; D6/610; 206/216; 384/4; 493/394; 1/210
See application file for complete search history.

(56) References Cited

U.S. PATENT DOCUMENTS

| | | | | | |
|---|---|---|---|---|---|
| 2,420,344 | A | * | 5/1947 | Alexander | 2/69 |
| 4,273,380 | A | * | 6/1981 | Silvestri | 297/188.6 |
| 4,375,111 | A | * | 3/1983 | Hall | 5/419 |
| 4,546,507 | A | * | 10/1985 | Weinstein | 5/419 |
| 4,634,618 | A | * | 1/1987 | Greer et al. | 428/81 |
| 4,991,245 | A | | 2/1991 | Franco | |
| D317,995 | S | * | 7/1991 | Crowley-McGregor | D6/608 |
| 5,072,467 | A | * | 12/1991 | Hunt | 5/417 |
| 5,081,727 | A | * | 1/1992 | Ippolito | 5/419 |
| 5,346,308 | A | * | 9/1994 | Buhot et al. | 383/4 |
| 5,414,881 | A | * | 5/1995 | Terrazas | 5/417 |
| D359,411 | S | * | 6/1995 | Wade | D6/610 |
| 5,454,125 | A | * | 10/1995 | Ratkowski | 5/417 |
| 5,463,783 | A | * | 11/1995 | Pope | 5/417 |
| 5,618,110 | A | * | 4/1997 | Sullivan | 383/4 |
| 5,629,071 | A | * | 5/1997 | Feldman | 428/192 |
| 5,644,807 | A | * | 7/1997 | Battistella | 5/419 |
| 5,688,052 | A | * | 11/1997 | Compton | 383/38 |
| D388,273 | S | * | 12/1997 | Propper | D6/608 |
| 5,693,398 | A | * | 12/1997 | Granger | 428/66.7 |
| 5,730,529 | A | | 3/1998 | Fritz | |
| 5,774,912 | A | * | 7/1998 | Dominique | 5/419 |
| 5,785,219 | A | | 7/1998 | Kraft | |

* cited by examiner

*Primary Examiner*—Mickey Yu
*Assistant Examiner*—Steven Pollicoff
(74) *Attorney, Agent, or Firm*—Robert E. Howard

(57) ABSTRACT

The combination of a towel or blanket and a flexible carrying case integral therewith. The carrying case is attached at a portion of its inner surface to the towel or blanket in an upper portion thereof. The carrying case is adapted to permit the towel or blanket to be stuffed inside during transport and storage of the towel or blanket, and adapted to receive a pillow when the towel or blanket has been withdrawn from the case for use. The towel or blanket additionally includes slip cover pockets located at one or both ends and adapted to be placed over the end or ends of a lounge chair. The towel or blanket further includes pockets for storing items.

34 Claims, 2 Drawing Sheets

TOWEL OR BLANKET WITH INTEGRAL CARRYING CASE

CROSS-REFERENCE TO RELATED APPLICATIONS

This application claims the benefit of U.S. Provisional Application No. 60/140,235, filed Jun. 21, 1999.

BACKGROUND OF THE INVENTION

The present invention relates to a towel or blanket having an integral carrying case.

People going to the beach, swimming pool, hiking, camping, etc. often carry a towel or blanket in one arm and miscellaneous items in their other hand, which is clumsy and inconvenient.

When laying down at the beach, etc., it is more comfortable if something can be found to place under your head. Pillows, however, are too bulky to carry very far.

When a towel is placed on a lounge chair it tends to slip off the chair. Items placed under the chair are sometimes forgotten when leaving.

SUMMARY OF THE PRESENT INVENTION

It is an object of the present invention to provide a towel or blanket having an integral carrying case which alleviates many of the foregoing problems.

The present invention provides a towel or blanket which can be stuffed into an attached case for easy carrying. The case is adapted to receive a pillow when the towel or blanket is deployed for use.

The invention comprises a rectangular sheet of towel or blanket type material.

The sheet has a case attached to its upper portion which can be used as a pillow case when the sheet is in use as a towel or blanket, and is used as the carrying/storage case for the sheet when it is not in use as a towel or blanket.

At least one pocket is located adjacent each of the longitudinal edges of the sheet for handy storage of personal items.

Slip cover pockets are attached at one or both ends of the sheet and are adapted to fit over the ends of a lounge chair.

DESCRIPTION OF THE PREFERRED EMBODIMENTS

The sheet of the present invention may be used as either a towel or blanket. In discussing the invention below, the sheet will be discussed relative to its use as a beach towel; however, it is to be understood that the sheet may be made of blanket type material and used as a blanket when camping, etc.

Towel 10 is a generally rectangular sheet 12 having ends 14 and 15 and longitudinal side edges 16 and 17.

Sheet 12 is a flexible material of the type used to make towels, such as terry cloth. However, many types of natural, synthetic or recycled materials may be used for making sheet 12 for use as a towel or blanket. Such materials include wool, rayon, polyester, velvet, silk, mock silk, cotton, cotton blends, nylon, knits, canvas, denim, vinyl, leather, suede, mock leather, suede and nubuck.

A case 20 is attached, such as by sewing a portion of the inner surface of case 20 to the upper portion of sheet 12. Case 20 is made of flexible material, preferably the same material as rectangular sheet 12. Sheet 12 is attached to case 20

Figure 5:
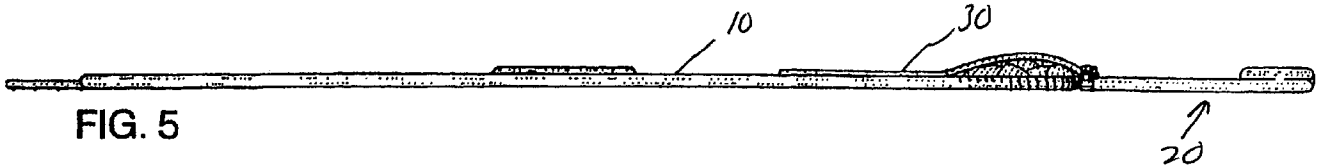
FIG. 5 is a perspective view of the case containing the towel or blanket of the present invention.

In a preferred embodiment, as best seen in FIG. 5, case 20 has substantially parallel front and rear walls 21 and 22, substantially parallel side walls 23 and 24, and a bottom wall 25.

Figure 1:
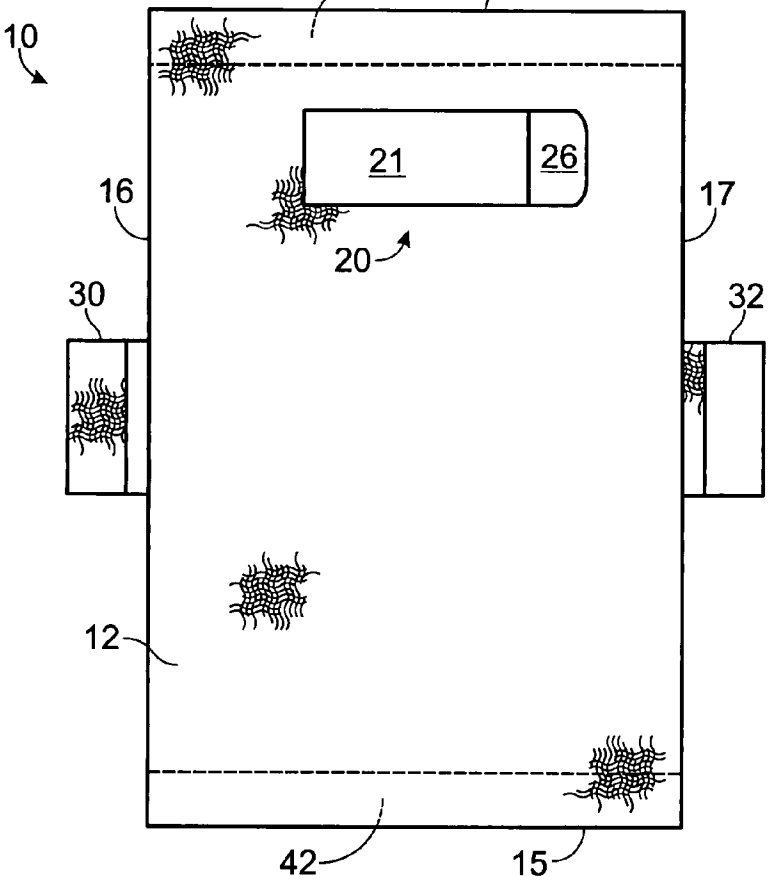
FIG. 1 is a top view of the towel or blanket of the present invention.

In the preferred embodiment shown in FIG. 5, the inner surface of the rear wall 22 of case 20 is attached to sheet 12. As viewed in FIG. 5, the inner surfaces of front and rear walls 21 and 22, side walls 23 and 24, and bottom wall 25 are all located inside case 20. In FIG. 1 the inner surface of front wall 21 is illustrated.

A flap 26 extends from the upper edge of rear wall 22 and can be folded down over the upper edge of front wall 21. Flap 26 can be secured to front wall 21 in any suitable manner, such as by mating snaps 27 and 28. However, other fastener means, such as a zipper, hook and loop fastener material, etc. may be used.

Carrying means comprised of a strap 29 is attached to case 20 for ease of carry. Although the carrying means is illustrated in FIG. 5 as being a purse type strap 29, the strap may be attached along one side wall 23 or 24 to provide a tote bag type strap, or a pair of straps attached to the rear wall 22 to provide a backpack type strap. A handle or drawstrings may be used as the carrying means.

Although the preferred embodiment of case 20 has been described as having front, rear, side and bottom walls, in an alternative embodiment (not shown) case 20 may be formed of only front and rear walls attached together along three sides. In yet another embodiment (not shown), case 20 may have a cylindrical shape open at one end.

Figure 2:
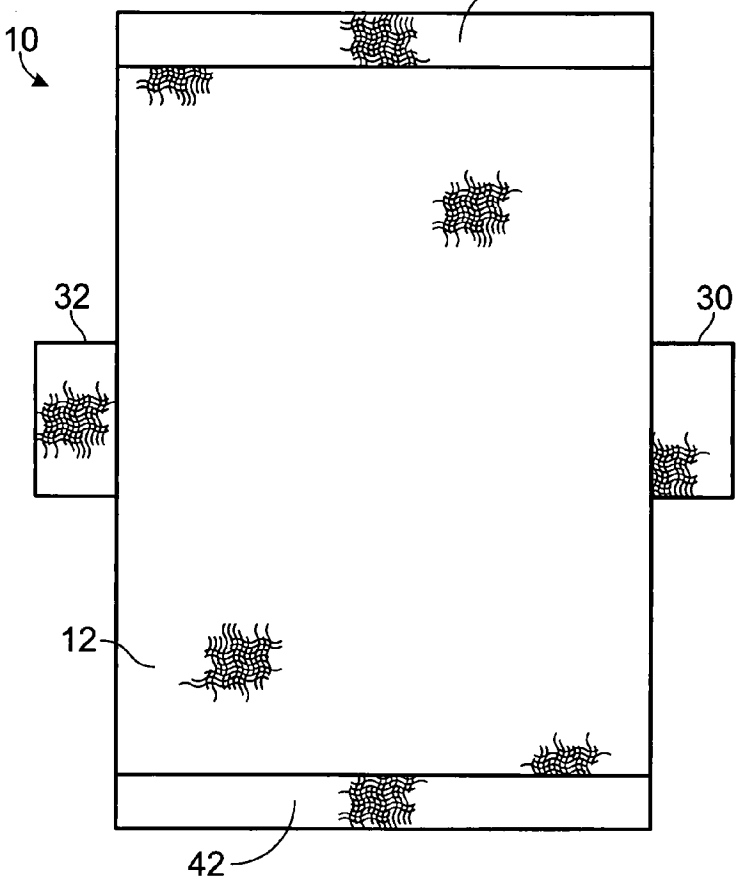
FIG. 2 is a back view of the towel or blanket of the present invention.
Figure 3:
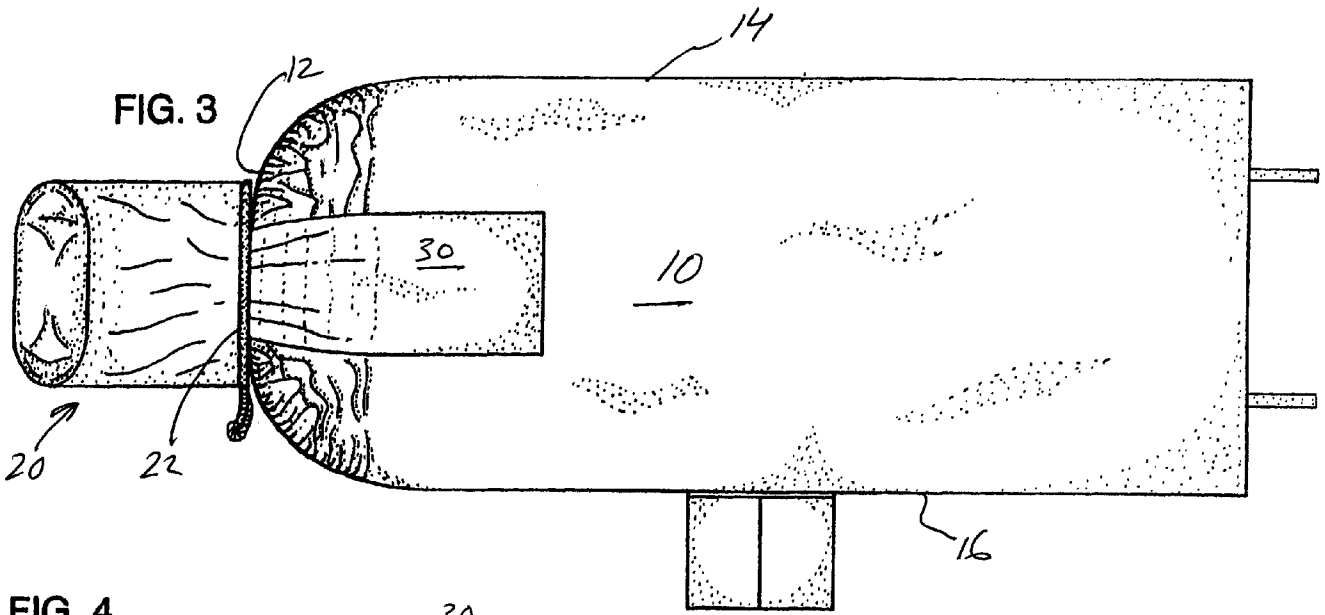
FIG. 3 is a top view of an alternative embodiment of the towel or blanket of the present invention.
Figure 4:
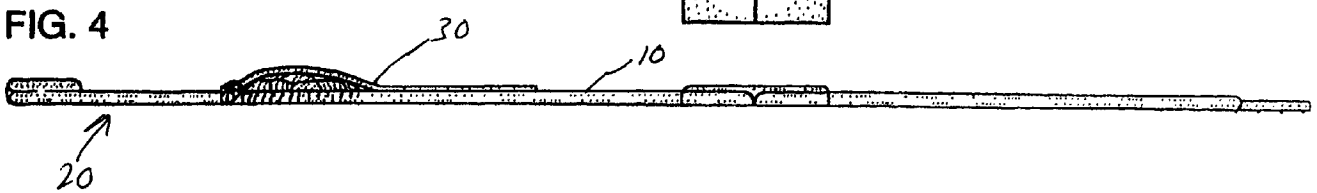
FIG. 4 is a right side view of a lounge chair having the towel or blanket of the present invention placed thereon.

As seen in FIGS. 1 and 2, storage pockets 30 and 32 may be located substantially on each longitudinal edge 16 and 17 in a mid-portion thereof. Alternatively, a plurality of storage pockets 34 and 36 may be located inboard of longitudinal edges 16 and 17, respectively, as seen in FIG. 3. Pockets 30, 32, 34 and 36 are used for storing items such as lotions, etc.

Upper and lower slip cover pockets 40 and 42 are used to secure the upper and lower ends 14 and 15, respectively, of towel 10 to the upper torso portion and the leg portion, respectively, of a lounge chair 50. Although in the preferred embodiment slip cover pockets 40 and 42 are located at each end of sheet 12, the invention also contemplates locating a single slip cover pocket 40 at only the upper end of sheet 12.

Slip cover pockets 40 and 42 may be easily formed by folding the ends of sheet 12 back on itself and sewing together the overlying edges.

When towel 10 is in use, i.e., the configuration shown in FIGS. 1–4, case 20 is reversed and a pillow (not shown) can be inserted into case 20. Preferably, the pillow is an inflatable type which can be more easily transported.

After completion of use, towel 10 is removed from lounge chair 50 and the pillow removed from case 20. Case 20 is then turned inside out (reversed) and sheet 12 stuffed inside reversed case 20. Flap 26 is secured to front wall 21 and the user carries case 20 by means of strap 29.

Deployment of towel 10 for use involves the reverse procedure, i.e., flap 26 is opened and sheet 12 pulled out of case 20. Case 20 is reversed for use as a pillow case.

For use in wet or damp locations, flexible sheet 12 may have a waterproof sheet of material attached to the bottom side thereof, such as by stitching the two together. The waterproof sheet should be substantially the same size as flexible sheet 12, i.e., the ends and side edges of the waterproof sheet should be substantially coextensive with the ends 14 and 15 and side edges 16 and 17 of sheet 12. The waterproof sheet may be made of a plastic material, such as polyethylene or vinyl, or a natural or synthetic rubber.

It will be obvious to those skilled in the art that many changes may be made to the above-described embodiments of this invention that employ the underlying principles thereof. The scope of the present invention should, therefore, be determined only by the following claims.

The invention claimed is:

1. A combination of a flexible sheet usable as a towel or blanket and a carrying case integral with said flexible sheet comprising:

a flexible, rectangular sheet having first and second ends and first and second longitudinal edges; and a flexible carrying case reversible from a transport and storage mode to a use mode by pulling said carrying case inside out, said carrying case having first and second ends and front and rear walls, said carrying case being open at said first end and closed at said second end, said front and rear walls of said carrying case in said transport and storage mode each having an outer surface and an inner surface, a portion of said inner surface of one of said front and rear walls of said carrying case being permanently attached to said sheet at a location inwardly of said first end of said sheet and between said first and second longitudinal edges of said sheet, said carrying case wholly containing said sheet within said carrying case in said transport and storage mode, said sheet being wholly deployed outside of said carrying case in said use mode with said open first end of said carrying case facing one of said longitudinal edges of said sheet and with said outer surface of said carrying case forming the inner surface of a pillow case.

2. The combination of claim 1 including a slip cover pocket located at said first end of said sheet, said slip cover being configured to be placed over that end of a lounge chair adapted to receive a user's torso.

3. The combination of claim 2 including a second slip cover pocket located at said second end of said sheet, said second slip cover pocket being configured to be placed over the other end of said lounge chair.

4. The combination of claim 1 including at least one pocket located adjacent each of said longitudinal edges of said sheet.

5. The combination of claim 4 wherein said pockets are all located substantially on said longitudinal edges of said sheet and extend away from said sheet.

6. The combination of claim 4 wherein said pockets are all located inwardly of said longitudinal edges of said sheet.

7. The combination of claim 1 including carrying means attached to said case adjacent said open end.

8. The combination of claim 7 wherein said carrying means is a strap.

9. The combination of claim 1 including a waterproof sheet attached to the bottom side of said flexible sheet, said waterproof sheet being substantially the same size as said flexible sheet.

10. The combination of claim 1 including a flap extending from said rear wall adjacent said open first end of said case, said flap adapted to be secured to said front wall of said case by fastener means when said sheet is stuffed inside said case for transport and storage.

11. A combination of a flexible sheet usable as a towel or blanket and a carrying case integral with said flexible sheet comprising:

a flexible, rectangular sheet having first and second ends and first and second longitudinal edges; and a flexible carrying case reversible from a transport and storage mode to a use mode by pulling said carrying case inside out, said carrying case having first and second ends and front and rear walls, said carrying case being open at said first end and closed at said second end, said front and rear walls of said carrying case in said transport and storage mode each having an outer surface and an inner surface, a portion of said inner surface of one of said front and rear walls of said carrying case being permanently attached to said sheet at a location inwardly of said first end of said sheet and between said first and second longitudinal edges of said sheet, said carrying case wholly containing said sheet within said carrying case in said transport and storage mode, said sheet being wholly deployed outside of said carrying case in said use mode with said open first end of said carrying case facing one of said longitudinal edges of said sheet and with said outer surface of said carrying case forming the inner surface of a pillow case;

a slip cover pocket located at said first end of said sheet, said slip cover being configured to be placed over that end of a lounge chair adapted to receive a user's torso; and at least one pocket located adjacent at least one of said longitudinal edges of said sheet.

12. The combination of claim 11 including a second slip cover pocket located at said second end of said sheet, said second slip cover pocket being configured to be placed over the other end of said lounge chair.

13. The combination of claim 11 including carrying means attached to said case adjacent said open end.

14. The combination of claim 11 including a flap extending from said rear wall adjacent said open first end of said case, said flap adapted to be secured to said front wall of said case by fastener means when said sheet is stuffed inside said case for transport and storage.

15. A process of transporting and storing a sheet usable as a towel or blanket inside a flexible carrying case, and deploying said sheet from said carrying case for usage, comprising:

providing a flexible, rectangular sheet having first and second ends and first and second longitudinal edges;

providing a flexible carrying case, said carrying case having first and second ends and front and rear walls, said carrying case being open at said first end and closed at said second end, said front and rear walls of said carrying case each having an outer surface and an inner surface;

attaching a portion of said inner surface of one of said front and rear walls of said carrying case to said sheet at a location inwardly of said first end of said sheet and between said first and second longitudinal edges of said sheet, said open first end of said carrying case facing one of said longitudinal edges of said sheet;

reversing said carrying case inside out and stuffing said sheet inside said carrying case to form a carrying case containing said sheet;

transporting said carrying case containing said sheet to a place of usage; and deploying said sheet for usage by removing said sheet from said carrying case and turning said carrying case inside out, said outer surface of said carrying case forming the inner surface of a pillow case.

16. The process of claim 15 wherein said first end of said sheet includes a slip cover pocket, and including the further step of placing said slip cover pocket over that end of a lounge chair adapted to receive a user's torso.

17. The process of claim 16 wherein said second end of said sheet includes a second slip cover pocket, and including the further step of placing said second slip cover pocket over the other end of said lounge chair.

18. The process of claim 15 wherein said sheet includes at least one pocket located adjacent each of said longitudinal edges of said sheet.

19. The process of claim 18 wherein said pockets are all located substantially on said longitudinal edges of said sheet and extend away from said sheet.

20. The process of claim 18 wherein said pockets are all located inwardly of said longitudinal edges of said sheet.

21. The combination of claim 15 wherein said flexible carrying case includes carrying means attached to said case adjacent said open end.

22. The process of claim 21 wherein said carrying means is a strap.

23. The process of claim 15 including attaching a waterproof sheet to the bottom side of said flexible sheet, said waterproof sheet being substantially the same size as said flexible sheet.

24. The process of claim 15 including extending a flap from said rear wall adjacent said open first end of said case, said flap adapted to be secured to said front wall of said case by fastener means when said sheet is stuffed inside said case for transport and storage.

25. A process of making a carrying case containing a sheet usable as a towel or blanket comprising:

providing a flexible, rectangular sheet having first and second ends and first and second longitudinal edges;

providing a flexible carrying case, said carrying case having first and second ends and front and rear walls, said carrying case being open at said first end and closed at said second end, said front and rear walls of said carrying case each having an outer surface and an inner surface;

attaching a portion of said inner surface of one of said front and rear walls of said carrying case to said sheet at a location inwardly of said first end of said sheet and between said first and second longitudinal edges of said sheet, said open first end of said carrying case facing one of said longitudinal edges of said sheet; and reversing said carrying case inside out and stuffing said sheet inside said carrying case.

26. The process of claim 25 including locating a slip cover pocket at said first end of said sheet, said slip cover being configured to be placed over that end of a lounge chair adapted to receive a user's torso.

27. The combination of claim 26 including locating a second slip cover pocket at said second end of said sheet, said second slip cover pocket being configured to be placed over the other end of said lounge chair.

28. The combination of claim 25 including locating at least one pocket adjacent each of said longitudinal edges of said sheet.

29. The combination of claim 28 wherein said pockets are all located substantially on said longitudinal edges of said sheet and extend away from said sheet.

30. The combination of claim 28 wherein said pockets are all located inwardly of said longitudinal edges of said sheet.

31. The combination of claim 25 including attaching a carrying means to said case adjacent said open end.

32. The combination of claim 25 wherein said carrying means is a strap.

33. The combination of claim 25 including attaching a waterproof sheet to the bottom side of said flexible sheet, said waterproof sheet being substantially the same size as said flexible sheet.

34. The combination of claim 25 including extending a flap from said rear wall adjacent said open first end of said case, said flap adapted to be secured to said front wall of said case by fastener means when said sheet is stuffed inside said case for transport and storage.

* * * * *